US005661366A

United States Patent [19]

Hirota et al.

[11] Patent Number: 5,661,366

[45] Date of Patent: Aug. 26, 1997

[54] ION BEAM ACCELERATING DEVICE HAVING SEPARATELY EXCITED MAGNETIC CORES

[75] Inventors: Junichi Hirota, Hitachi; Yoshihisa Iwashita, Uji, both of Japan

[73] Assignee: Hitachi, Ltd., Tokyo, Japan

[21] Appl. No.: 550,984

[22] Filed: Oct. 31, 1995

[30] Foreign Application Priority Data

Nov. 4, 1994 [JP] Japan ..... 6-270889

[51] Int. Cl.[6] ..... H05H 13/00

[52] U.S. Cl. ..... 315/5.41; 315/501; 313/359.1

[58] Field of Search ..... 315/5.41, 500, 315/501, 502, 503, 504, 505, 507; 313/359.1

[56] References Cited

U.S. PATENT DOCUMENTS

| | | | |
|---|---|---|---|
| 4,047,068 | 9/1977 | Ross et al. | 315/501 |
| 4,700,108 | 10/1987 | Morse | 315/5.41 |
| 4,730,166 | 3/1988 | Birx et al. | 315/500 |
| 4,763,079 | 8/1988 | Neil | 315/111.51 X |
| 5,363,008 | 11/1994 | Hiramoto et al. | 315/500 X |

FOREIGN PATENT DOCUMENTS

| | | | |
|---|---|---|---|
| 705879 | 4/1941 | Germany . | |
| 63-76299 | 4/1988 | Japan . | |
| 1170948 | 2/1986 | Russian Federation | 315/500 |
| 365765 | 1/1963 | Switzerland . | |

OTHER PUBLICATIONS

"High Frequency Accelerating Cavity for Proton Synchrotron," High Energy Device Seminar oHO '89, pp. V–19 to V–30, Sep. 1989.

"Induction Linear Accelerations and Their Applications", J. Leiss, IEEE Transaction on Nuclear Science, vol. NS–26, No. 3, Jun. 1979, pp. 3870–3876.

"Multichannel Hybrid Power Splitter for Meter and Decimeter Wavelength Range", Mikhailov et al, Intrum. Exp. Tech. (USA), Instruments and Experimental Techniques, vol. 21, No. 1, pt. 2, Jan.–Feb. 1978.

"A Pulsed Power Design for the Linear Inductive Accelerator Modules for the Laboratory Microfusion Facility", D. Smith et al, Digest of Technical Papers, 9th IEEE International Pulsed Power Conference, vol. 1, pp. 419–422.

(List continued on next page.)

*Primary Examiner*—Benny T. Lee
*Assistant Examiner*—Justin P. Bettendorf
*Attorney, Agent, or Firm*—Antonelli, Terry, Stout & Kraus, LLP

[57] ABSTRACT

An ion beam accelerating device includes an accelerating cavity including an accelerating cavity outer conductor having a space therein, two accelerating cavity inner conductors though which an ion beam passes and which penetrate respective side walls of the accelerating cavity outer conductor and are separated from each other by a gap in the accelerating cavity outer conductor, and a plurality of magnetic cores disposed in the accelerating cavity outer conductor and surrounding one or both of the accelerating cavity inner conductors. The ion beam accelerating device further includes a plurality of high frequency magnetic field generating units equal in number to the magnetic cores for inducing respective high frequency magnetic fields in respective ones of the magnetic cores, thereby generating an accelerating voltage across the gap so as to accelerate the ion beam passing through the accelerating cavity inner conductors. Alternatively, the magnetic cores may be divided into a plurality of groups of magnetic cores, and the ion beam accelerating device may include a plurality of high frequency magnetic field generating units equal in number to the groups of magnetic cores for inducing respective high frequency magnetic fields in respective ones of the groups of magnetic cores.

13 Claims, 8 Drawing Sheets

OTHER PUBLICATIONS

"A Coaxial–Type Accelerating System with Amorphous Material", Krasnopolsky, Proceedings of the 1993 Particle Accelerator Conference, vol. 2, pp. 933–935.

Japanese Laid–Open Patient Publication No. Sho 63–76299 (1988).

"High Frequency Accelerating Cavity for Proton Synchrotron" pp. v–19 to v–30, the High Energy Accelerating device Seminar OHO '89. Sep. 1989.

ION BEAM ACCELERATING DEVICE HAVING SEPARATELY EXCITED MAGNETIC CORES

BACKGROUND OF THE INVENTION

The present invention relates to an ion beam accelerating device for providing energy to charged particles, and in particular, to an ion beam accelerating device which is suitable for application to a medical use or physical experiments.

First of all, an accelerating cavity to be used for accelerating ion beams will be described in the following. Because a proton which has the lightest mass of ions is about 2000 times heavier than an electron, the relativistic effect of ions is small. Therefore, the velocity of an ion is generally slow, and in addition, ion velocity undergoes a substantial change during acceleration. Thereby, in order to accelerate an ion beam to a predetermined energy level, a magnetic core-loaded accelerating cavity in which magnetic cores are installed is used by advantageously decreasing its resonant frequency in accordance with the magnetic permeability of the loaded magnetic cores. There are two types of this magnetic core-loaded accelerating cavity: one is a tuned-type accelerating cavity, which uses a magnetic core having a low magnetic loss and controls the magnetic permeability of the magnetic core by applying a bias magnetic field using a bias current, so that the magnetic permeability thereof is tuned to the resonant frequency; and the other is an untuned-type accelerating cavity, which actively makes use of magnetic loss and can broaden the resonance frequency band, although its cavity voltage is lowered, thus requiring no bias device.

One such prior art accelerating cavity and its power supply method has been described in "High Frequency Accelerating Cavity for Proton Synchrotron", pp. V-19 to V-30, High Energy Accelerating Device Seminar, OHO '89.

FIG. 1 is a schematic diagram of a conventional untuned-type accelerating cavity 3 and its power supply.

In FIG. 1, the accelerating cavity 3 is comprised of accelerating cavity outer conductor 10; accelerating cavity inner conductor 11A, through the inside of which ion beam 60 passes, which inner conductor is disposed to penetrate one of the side walls of the accelerating cavity outer conductor 10; accelerating cavity inner conductor 11B, which is disposed to penetrate the other side wall of the accelerating cavity outer conductor 10; eight toroidal magnetic cores 20, each disposed around the outer surface of the accelerating cavity inner conductor 11A within the accelerating cavity outer conductor 10; and a gap 12 formed between the accelerating cavity inner conductors 11A and 11B. Each side wall at both end portions of the accelerating cavity outer conductor 10 is connected to one of the accelerating cavity inner conductors 11A and 11B. The other ends of the accelerating cavity inner conductors 11A and 11B are connected respectively to a vacuum duct of a circular accelerating device (not shown).

A high-frequency supply of power, which is output from a high-frequency power source 30, is applied across the accelerating cavity inner conductor 11A and the accelerating cavity outer conductor 10, and both conductors in combination constitute a coaxial structure. This power supply method will be referred to as a direct coupling or direct power supply arrangement. By means of this direct power supply arrangement, high-frequency current 41 is caused to flow between the accelerating cavity inner conductor 11A and the accelerating cavity outer conductor 10.

This high frequency current 41 generates a high frequency magnetic field 42. Then, the high frequency magnetic field 42 and the toroidal magnetic cores 20 disposed within the accelerating cavity outer conductor 10 are inductively coupled to generate an accelerating voltage in the gap 12.

By way of example, an accelerating cavity as disclosed in JP-A Laid-Open No. 63-76299 is arranged to supply electric power using the same direct power supply arrangement as in the prior art accelerating cavity 3 of FIG. 1.

SUMMARY OF THE INVENTION

A first object of the invention is to provide an ion beam accelerating device which has an improved utilization efficiency of high frequency power.

A second object of the invention is to provide an ion beam accelerating device having an increased accelerating voltage.

A first aspect of the invention to accomplish the first object of the invention is characterized by the provision of means for generating an individual high frequency magnetic field to be applied to each one of a plurality of magnetic cores or an individual group thereof.

A second aspect of the invention to accomplish the second object of the invention is characterized in that the aforementioned means for generating an individual high frequency magnetic field includes a high frequency power supply and a plurality of coaxial cables connected to the high frequency power supply for transmitting high frequency power, and that an inner conductor of each coaxial cable is wound around a respective toroidal magnetic core or a group of toroidal magnetic cores and a tip of the inner conductor of the coaxial cable is in contact with the accelerating cavity outer conductor, and a tip of the outer conductor of each coaxial cable is also in contact with the accelerating cavity outer conductor.

BRIEF DESCRIPTION OF THE DRAWINGS

Other features and advantages of the invention will be apparent from the following description taken in connection with the accompanying drawings, wherein:

FIG. 3(*b*) is another equivalent circuit diagram of FIG. 3(*a*) which is divided into n units;

DESCRIPTION OF THE PREFERRED EMBODIMENTS

Figure 1:
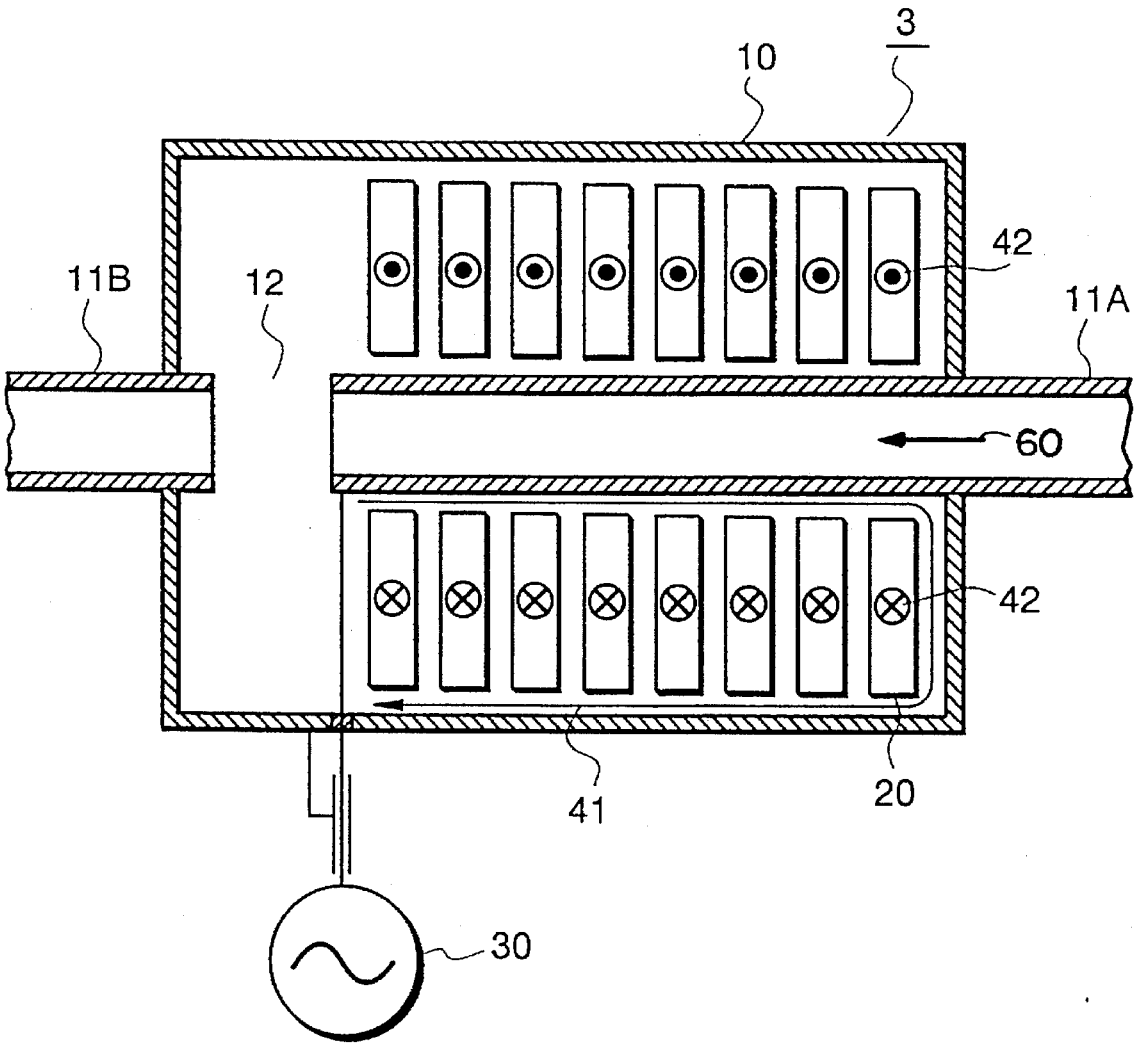
FIG. 1 PRIOR ART
FIG. 1 is a diagram illustrative of arrangements of a prior art accelerating cavity and its power supply.

The inventors of the present invention have considered in detail the characteristics of the prior art accelerating cavity 3 shown in FIG. 1 and the accelerating cavity disclosed in JP-A Laid-Open No. 63-76299. As a result, the inventors have discovered a critical problem associated with these prior art accelerating cavities, that is, the fact that their utilization efficiencies of high frequency power are very low. The present invention has been made to solve this newly discovered critical problem.

The result of the aforementioned consideration of the prior art will be described in detail in the following. With reference to FIG. 1, in the prior art accelerating cavity 3, an accelerating voltage V to be generated in gap 12 will be given by the following equation 1, where P is the net cavity power, and Z is the cavity impedance:

$$V=\sqrt{2PZ} \quad \text{(eq. 1)}$$

When the impedance Z of the accelerating cavity 3 is substantially equal to the impedance $Z_d$ of the magnetic cores, the accelerating voltage $V_d$ occurring in the gap 12 will be expressed in terms of $Z_d$ by the following equation 2:

$$V_d=\sqrt{2PZ_d}=\sqrt{2\frac{4Z_dZ_0}{(Z_d+Z_0)^2}Z_dP_g} \quad \text{(eq. 2)}$$

Further, P will be given by the following equation 3:

$$P=(1-\Gamma^2)P_g=\frac{4Z_dZ_0}{(Z_d+Z_0)^2}P_g \quad \text{(eq. 3)}$$

where $P_g$ is an output power from the high frequency power supply, $Z_0$ is a characteristic transmission impedance ($Z_0$=50 Ω), and Γ is a voltage reflection coefficient. Assuming Z is a pure resistance, then $\Gamma=(Z-Z_0)/(Z+Z_0)$ when $Z>Z_0$ and $\Gamma=(Z_0-Z)/(Z_0+Z)$ when $Z<Z_0$.

The impedance $Z_d$ of the magnetic cores to be installed within the accelerating cavity 3 is generally large, and so the impedance Z of the accelerating cavity 3 is determined almost entirely by $Z_d$. There is a relationship between the power transmission impedance $Z_0$ and the impedance Z of the accelerating cavity 3 such that $Z=Z_d>>Z_0$, thereby causing an impedance mismatch to occur therebetween. Thus, assuming, for example, that Z=1 kΩ, the net cavity power P becomes less than 20% of the output power $P_g$ from the high frequency power supply 30. The rest of the power is reflected to the high frequency power supply 30 to be dissipated therein, with the result that the utilization efficiency of the high frequency power is very low.

The above problem is also present in the accelerating cavity disclosed in JP-A Laid-Open No. 63-76299.

As a result of a thorough and extensive study to try to solve the problem associated with the prior art, it has been discovered that an inductive coupling by use of the inductance of the magnetic cores will also cause an accelerating voltage to occur in the accelerating cavity. The inventors have successfully improved the utilization efficiency of the high frequency power supply greatly through this inductive coupling, that is, by individually supplying a high frequency power to each one of the plurality of magnetic cores or to each group of a plurality of groups of magnetic cores. Preferred embodiments of the invention will be described in detail in the following.

Figure 2:
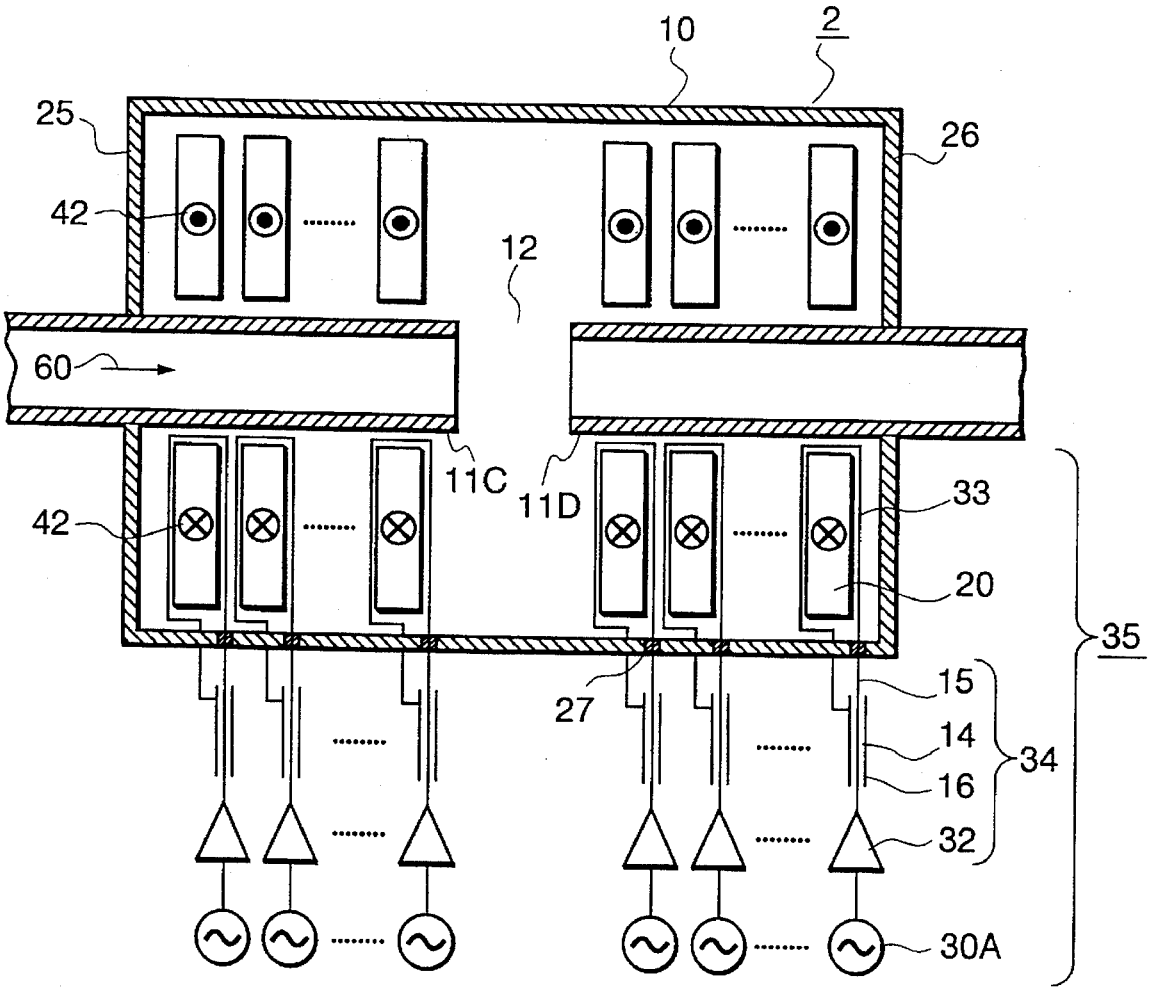
FIG. 2 is a diagram of an ion beam accelerating device forming one embodiment of the invention.

With reference to FIG. 2, an ion beam accelerating device forming an embodiment of the invention will be described below.

The ion beam accelerating device of this embodiment is comprised of accelerating cavity 2 having a plurality of toroidal magnetic cores 20 mounted therein, and a corresponding number of high frequency magnetic field generating units 35.

The accelerating cavity 2, which is of an untuned type, includes accelerating cavity outer conductor 10, accelerating cavity inner conductors 11C and 11D, through the inside of which ion beam 60 passes, and a plurality of toroidal magnetic cores 20 which are disposed to surround the accelerating cavity inner conductors 11C and 11D, respectively, in a space within the accelerating cavity outer conductor 10. More particularly, n/2 toroidal magnetic cores 20 are mounted around each of the accelerating cavity inner conductors 11C and 11D, which n is the total number of toroidal magnetic cores 20. Each one of the plurality of toroidal magnetic cores 20 has the same magnetic permeability. The individual impedance of each of the plurality of toroidal magnetic cores 20 is $Z_d$/n.

Each of the accelerating cavity inner conductors 11C and 11D is disposed to penetrate a different side wall of the accelerating cavity outer conductor 10 so as to oppose each other with a gap 12 therebetween.

Gap 12 provided between the accelerating cavity inner conductors 11C and 11D is disposed in the path of ion beam 60 at the center of the accelerating cavity outer conductor 10.

The side walls 25 and 26 of the accelerating cavity outer conductor 10 are connected respectively to the accelerating cavity inner conductors 11C and 11D.

The high frequency magnetic field generating units 35 include a plurality of power supply lines 34, one for each of the plurality of toroidal magnetic cores 20, and winding portions 33 connected respectively to the plurality of power supply lines 34 and wound around the plurality of toroidal magnetic cores 20, respectively, to induce high frequency magnetic fields therein. Each of the power supply lines 34 includes a high frequency power source 30A, an amplifier 32, one end of which is connected to an output terminal of the high frequency power source 30A, and a coaxial cable 14 connected to an output terminal of the amplifier 32.

An inner conductor 15 of each coaxial cable 14 is wound around a respective toroidal magnetic core 20 to form a winding portion 33, and the tip of the inner conductor 15 is in contact with the accelerating cavity outer conductor 10. A hole in the accelerating cavity outer conductor 10 through which the inner conductor 15 of the coaxial cable 14 penetrates is hermetically sealed with an electrical insulator 27, which insulates the inner conductor 15 of the coaxial cable 14 from the accelerating cavity outer conductor 10. An outer conductor 16 of the coaxial cable 14 is connected to the accelerating cavity outer conductor 10.

The high frequency power from the high frequency power source 30A is amplified by amplifier 32, and the amplified high frequency power is supplied through coaxial cable 14 to a toroidal magnetic core 20.

Since the inner conductor 15 is wound around the toroidal magnetic core 20, a high frequency current flowing through the inner conductor 15 induces a high frequency magnetic field 42 inside the toroidal magnetic core 20.

By means of the high frequency magnetic field 42 thus induced in each toroidal magnetic core 20, high frequency power can be supplied to the accelerating cavity 2 more efficiently, thereby producing a greater accelerating voltage in the gap 12. Thereby, the ion beam 60 is accelerated by this accelerating voltage every time it passes through the gap 12.

Figure 3A:
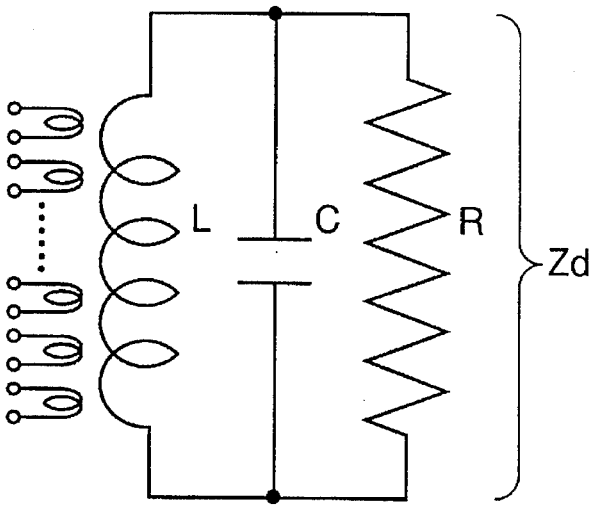
FIG. 3(*a*) is an equivalent circuit diagram of the ion beam accelerating device according to the invention.
Figure 3B:
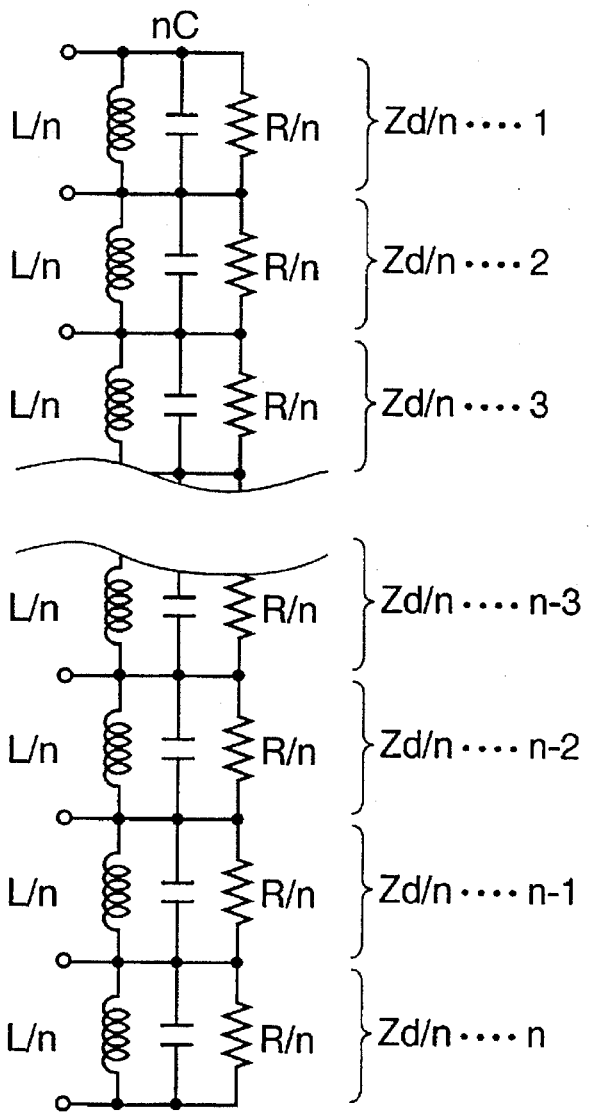

FIG. 3(*a*) shows an equivalent circuit of the accelerating cavity according to the invention, as viewed from the high frequency magnetic field generating units 35.

In accordance with the invention, since high frequency power is supplied to the accelerating cavity 2 via a plurality of toroidal magnetic cores 20, it can be said that there exists an inductive coupling between the high frequency power supply and the accelerating cavity 2, which makes use of the inductance of the toroidal magnetic cores 20.

Further, the equivalent circuit of FIG. 3(*a*) can be expressed in terms of inductance L/n, which represents the inductance of each toroidal magnetic core 20, as indicated in FIG. 3(*b*).

An impedance $Z_n$ of the accelerating cavity 2 connected to one of the power supply lines 34 is equal to $Z_d/n$, which represents the impedance of one of the n toroidal magnetic cores 20. Therefore, the accelerating cavity 2 of the invention comprising n toroidal magnetic cores 20 can be construed as if it is comprised of n accelerating cavities connected in series, each cavity having an impedance $Z_d/n$.

Assuming that one coaxial cable 14 transmits a high frequency power $P_g/n$, then an accelerating voltage $V_n$ to be generated in the gap 12 is given by the following equation 4:

$$V_n = \sqrt{2PZ_n} = \sqrt{n\,2\frac{4\frac{Z_d}{n}Z_0}{\left(\frac{Z_d}{n}+Z_0\right)^2}\frac{Z_d}{n}\frac{P_g}{n}} \simeq \sqrt{n}\,V_d\,(Z_d >> Z_0, n) \quad \text{(eq. 4)}$$

Therefore, the accelerating cavity 2 according to the invention can generate an accelerating voltage $\sqrt{n}$ times greater than that in the prior art direct coupling accelerating cavity.

By way of example, in the prior art accelerating cavity to which the high frequency power is supplied through direct coupling, only a single power supply line is provided, and a net impedance Z of the accelerating cavity equals the impedance $Z_d$ of n magnetic cores.

In the present invention, however, the load impedance $Z_n$ in each one of the n power supply lines 34 is given by $Z_d/n$, which represents the impedance of each one of the plurality of toroidal magnetic cores 20.

Namely, according to the present invention, the load impedance $Z_n$ in the power supply line 34 is substantially reduced so as to approach the characteristic impedance $Z_0$ of the power supply line.

Thereby, an impedance mismatch between the power supply line 34 and the load can be substantially decreased, thereby reducing the reflection power. In the high frequency magnetic field generating units 35, the supply of high frequency power to the accelerating cavity 2 is substantially increased and the reflection power which is wasted is substantially decreased. Thereby, the dissipation of the reflection power in the high frequency power sources 30A is reduced, and in turn, the utilization efficiency of the high frequency power is improved accordingly.

Further, by winding each inner conductor 15 of the coaxial cables 14 around a respective magnetic core, a high frequency magnetic field 42 can be induced efficiently inside the magnetic core. In addition, since the magnetic core is formed into a toroidal shape, the leakage magnetic flux can be minimized, thereby making it possible to induce a large high frequency magnetic field 42 within the accelerating cavity 2. Through this high frequency magnetic field 42, the transmitted high frequency power can be supplied into the accelerating cavity 2, thereby producing a greater accelerating voltage in the gap 12.

The invention has been described above by way of example with respect to an untuned type accelerating cavity, but it is not limited thereto, and the same effect and advantage of the invention will be obtained using a tuned type accelerating cavity as well. The same will apply to all embodiments of the invention.

Figure 4:
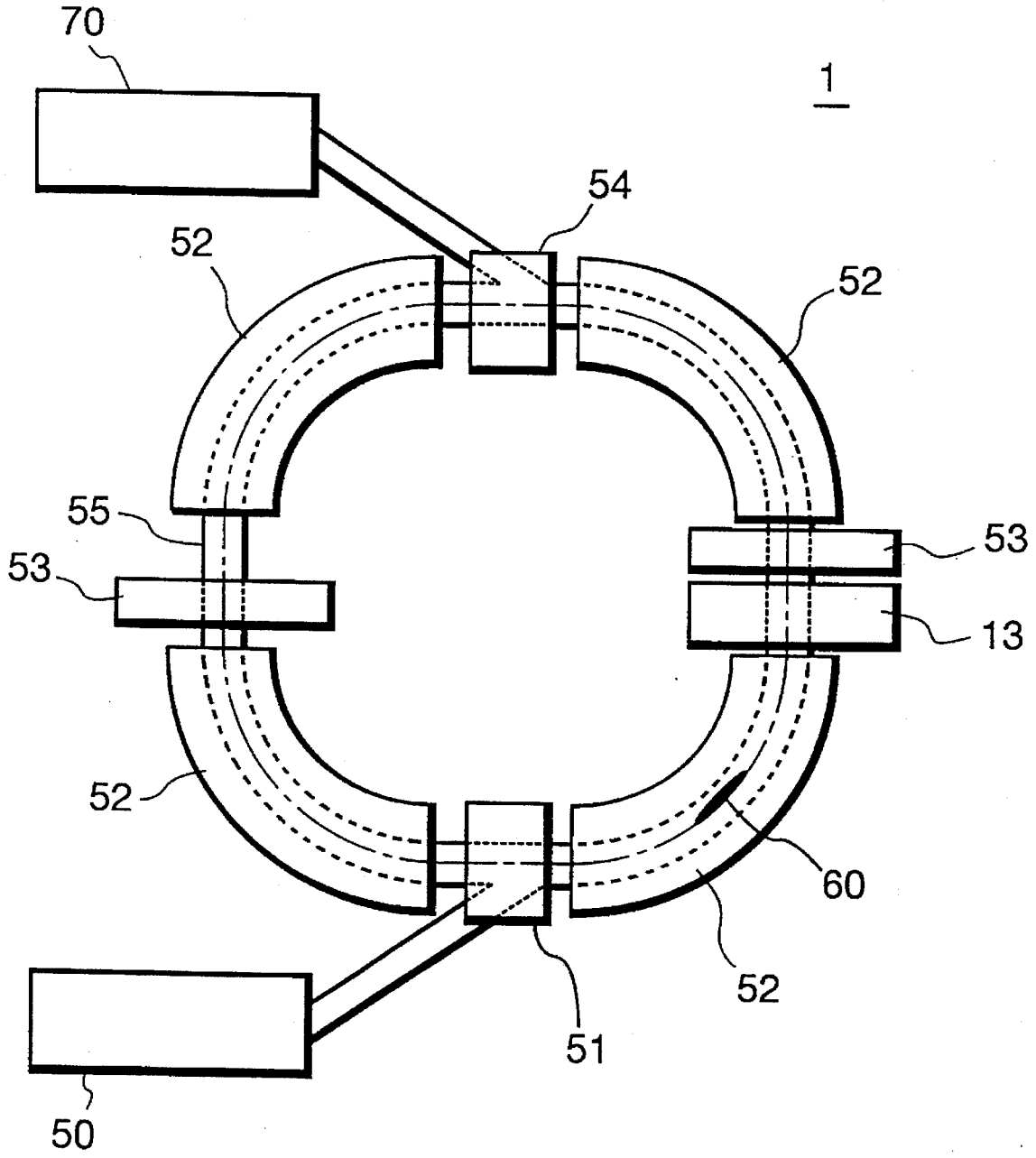
FIG. 4 is a diagram of an accelerating device which uses an ion beam accelerating device of the invention.

With reference to FIG. 4, there is illustrated a circular accelerating device 1 for use in medical treatment to which an ion beam accelerating device 13 of the invention is applied.

The circular accelerating device 1 is comprised of injector 51 for injecting ion beam 60, which has been accelerated by injector accelerating device 50, bending magnets 52 for bending the orbit of the ion beam 60 injected from the injector 51, quadrupole magnets 53 for diverging or converging the ion beam 60, extractor 54 for extracting ion beam 60 to an experimental laboratory or medical treatment room 70, and ion beam accelerating device 13 which is disposed along the toroidal vacuum duct 55, through the inside of which the ion beam 60 passes.

Ion beam 60 after having been accelerated by injector accelerating device 50 is injected into the circular accelerating device 1 through injector 51. After it has been accelerated to a predetermined energy level, ion beam 60 is extracted from the circular accelerating device 1 through extractor 54. The extracted ion beam is utilized in the experimental laboratory or medical treatment room 70.

The ion beam accelerating device 13 of the invention will be described with reference to FIGS. 5 and 6 in the following. FIG. 6 is a cross-sectional view of the ion beam accelerating device 13 taken along the line VI—VI in FIG. 5.

The ion beam accelerating device 13 comprises accelerating cavity 2 having eight toroidal magnetic cores 20 mounted therein, and high frequency magnetic field generating units 35A.

The accelerating cavity 2 in this example is of the untuned type having the same construction as that of FIG. 2.

The outer ends of the respective accelerating cavity inner conductors 11C and 11D are connected to vacuum duct 55 of the circular accelerating device 1.

High frequency magnetic field generating units 35A are comprised of a single high frequency power source 30B for producing high frequency power instead of the plurality of high frequency power sources 30A provided in the arrangement of FIG. 2, and a power splitter 31 having one input pin and eight output pins, with the one input pin thereof being connected to the output of the high frequency power source 30B.

Eight power supply (transmission) lines 34 and eight winding portions 33 are provided respectively for toroidal magnetic cores 20 similar to the arrangement of FIG. 2. Each of the power supply lines 34 includes a coaxial cable 14 and an amplifier 32. Each amplifier 32 is connected to one of the eight output pins of the power splitter 31.

The arrangement and electric connections of inner conductor 15 and outer conductor 16 of each coaxial cable 14 are the same as in FIG. 2.

A high frequency power output from the high frequency power source 30B is split into eight high frequency power outputs by the power splitter 31. Each of the high frequency power outputs from the power splitter 31 is amplified by a respective amplifier 32. The magnitude and phase of each of the amplified high frequency power outputs are the same. The amplified high frequency power outputs are transmitted via respective coaxial cables 14 to respective toroidal magnetic cores 20.

Since inner conductor 15 of each coaxial cable 14 is wound around a respective toroidal magnetic core 20, a high frequency current flowing through the inner conductor 15 will efficiently induce a high frequency magnetic field 42 within each toroidal magnetic core 20.

Through this high frequency magnetic field 42 induced in each toroidal magnetic core, high frequency power is effectively supplied into the accelerating cavity 2. Thus, an accelerating voltage is produced in gap 12 between accelerating cavity inner conductors 11C and 11D. Therefore, ion beam 60 is accelerated by this accelerating voltage when it passes through the gap 12.

An equivalent circuit of the invention and its resultant accelerating voltage will be described in the following.

With reference to FIG. 3(*b*), the equivalent circuit of this example of the invention corresponds to an instance when n=8. Therefore, the accelerating voltage $V_8$ to be generated in the gap 12 in this instance will be given by substituting 8 for the parameter n in equation 4 so that n=8, resulting in the following equation 5:

$$V_8 = \sqrt{2PZ_8} = \sqrt{8\left(2\frac{4\frac{Z_d}{8}Z_0}{\left(\frac{Z_d}{8}+Z_0\right)^2}\frac{Z_d}{8}\frac{P_g}{8}\right)} \simeq \sqrt{8}\,V_d\,(Z_d >> Z_0) \quad \text{(eq. 5)}$$

where $V_d$ is the accelerating voltage that the direct-coupled accelerating cavity of the prior art produces. Thereby, the accelerating cavity 2 according this example of the invention can produce an accelerating voltage about 3 times as great as $V_d$.

Now, regarding the impedance of this example of the invention, an impedance $Z_8$ of the accelerating cavity 2 with respect to a single power supply line 34 is $Z_d/8$ which is an impedance of a single toroidal magnetic core 20.

Namely, according to the invention, a load impedance $Z_8$ in the power supply line 34 is reduced, and approaches $Z_0$ which is the characteristic impedance of the power supply line.

Thereby, the utilization efficiency of the high frequency power can be improved significantly.

Further, since the magnitude and phase of each high frequency power output which is transmitted through each coaxial cable 14 are the same, and the direction of winding of each inner conductor 15 is the same, the magnitude and phase of each high frequency magnetic field 42 induced in each of the eight toroidal magnetic cores 20 are the same. Further, the inner conductor 15 of the coaxial cable 14 wound around the toroidal magnetic core 20 can efficiently induce a high frequency magnetic field in each magnetic core. In addition, since the magnetic core is formed into a toroidal shape, leakage of magnetic flux is minimized. Thereby, a large net high frequency magnetic field 42 can be obtained in the accelerating cavity 2 according to the invention. Through this high frequency magnetic field 42, the transmitted high frequency power can be supplied to the accelerating cavity 2 at a high utilization efficiency, thereby ensuring generation of a high accelerating voltage therein.

Further, since each power supply line 34 is provided with an amplifier 32, the high frequency power source 30B may have a small output rating. Thereby, a small capacity power splitter 31 and small power capacity amplifiers 32 can be used. Thus, the high frequency magnetic field generating units 35A can be reduced in size, so that a more compact ion beam accelerating device 13 can be provided.

Further, it is not necessary to synchronize respective high frequency power outputs from respective amplifiers 32 since the power splitter 31 is connected to a single high frequency power source 30B. In the case of the example of FIG. 2, however, since a plurality of individual high frequency power sources 30A are provided, it becomes necessary to provide additional means for synchronizing respective high frequency power outputs from respective amplifiers 32. According to the example of FIG. 5, on the other hand, since such additional means for synchronizing respective high frequency power outputs is not necessary, a more compact configuration of the equipment than that of the first example can be achieved.

Figure 7:
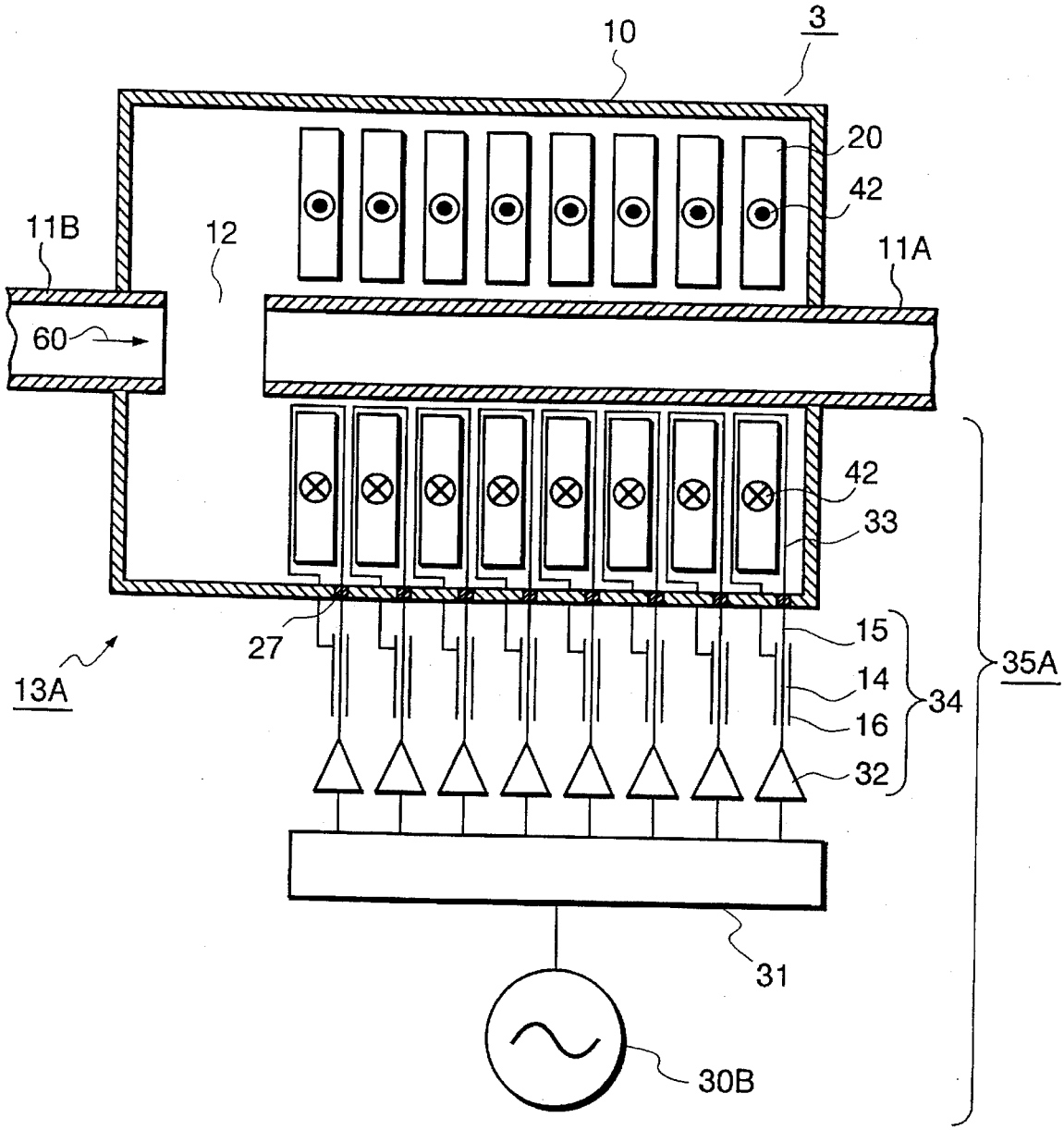
FIG. 7 is a diagram of another ion beam accelerating device of the invention.

With reference to FIG. 7, another ion beam accelerating device 13A according to the invention will be described. In this example of the invention, a plurality of power supply lines 34 are provided for respective toroidal magnetic cores 20 in the same way as in the previous examples, but all of the toroidal magnetic cores 20 are disposed on the accelerating cavity inner conductor 11A. According to this arrangement, through the use of the same action of inductive coupling as in the example of FIG. 5, there have been achieved an improved utilization efficiency of the high frequency power supplied and a greater accelerating voltage.

Figure 8:
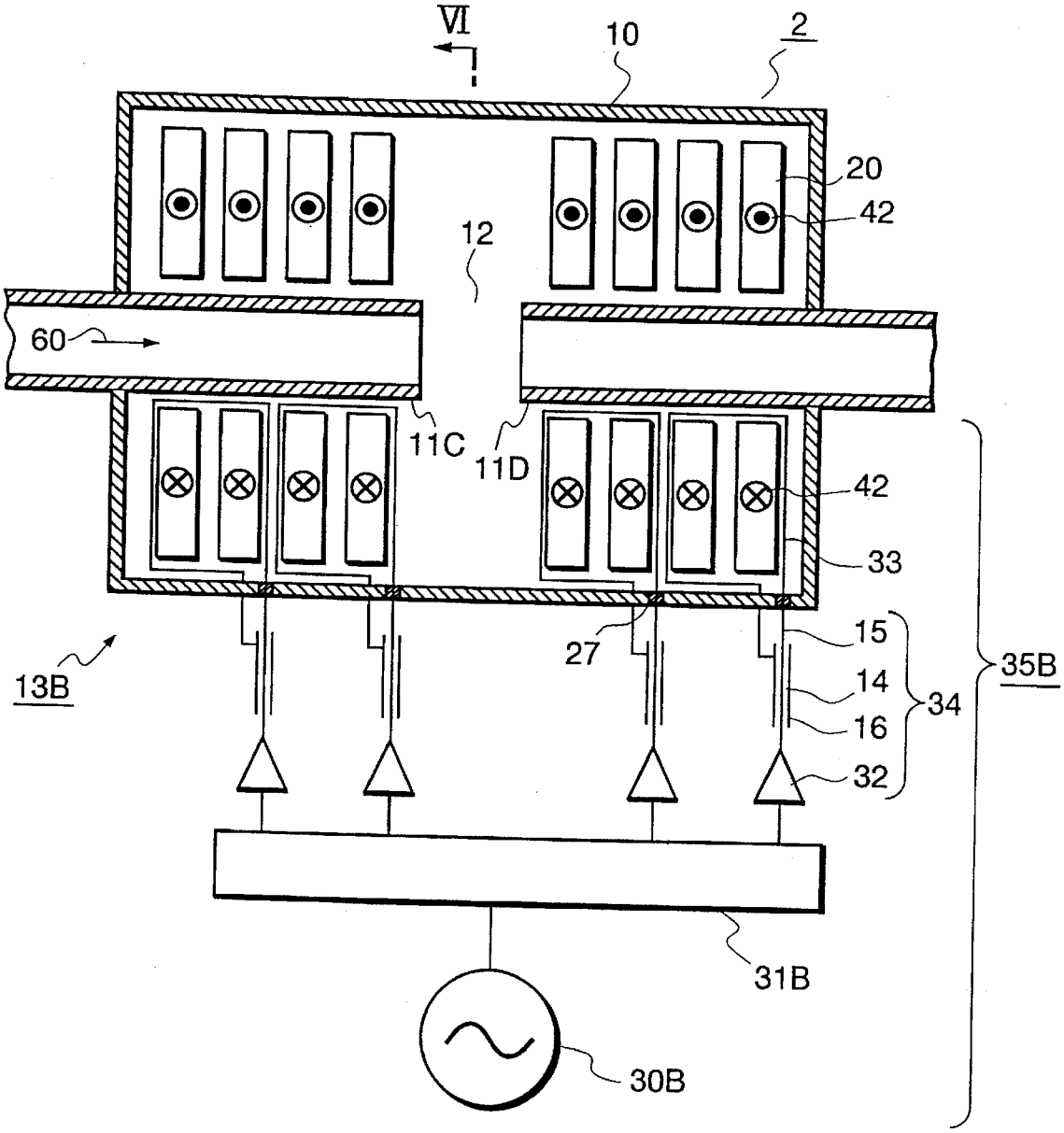
FIG. 8 is a diagram of a further ion beam accelerating device of the invention.

With reference to FIG. 8, still another example of an ion beam accelerating device 13B of the invention will be described in the following.

Figure 5:
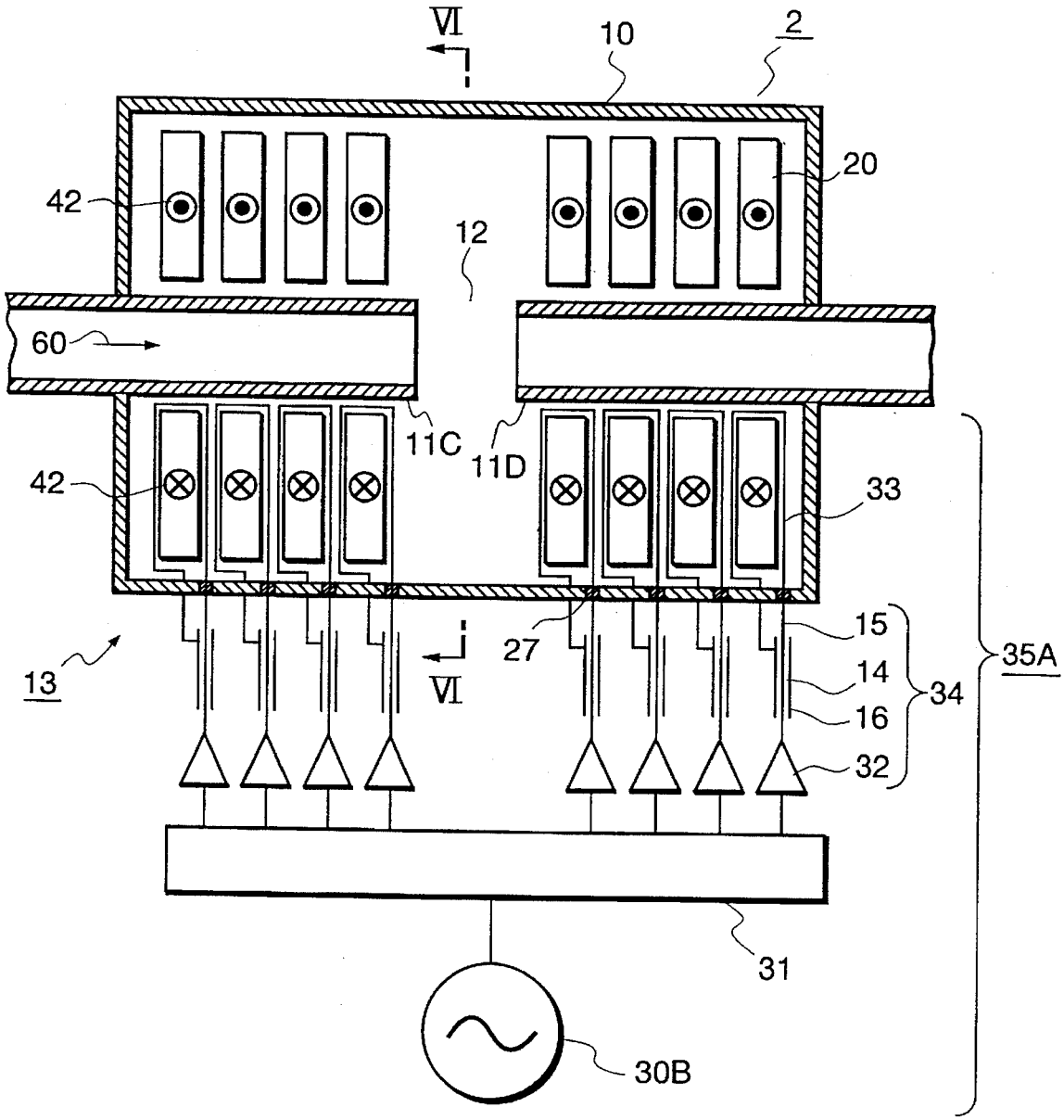
FIG. 5 is a diagram showing a detailed configuration of the ion beam accelerating device of FIG. 4.
Figure 6:
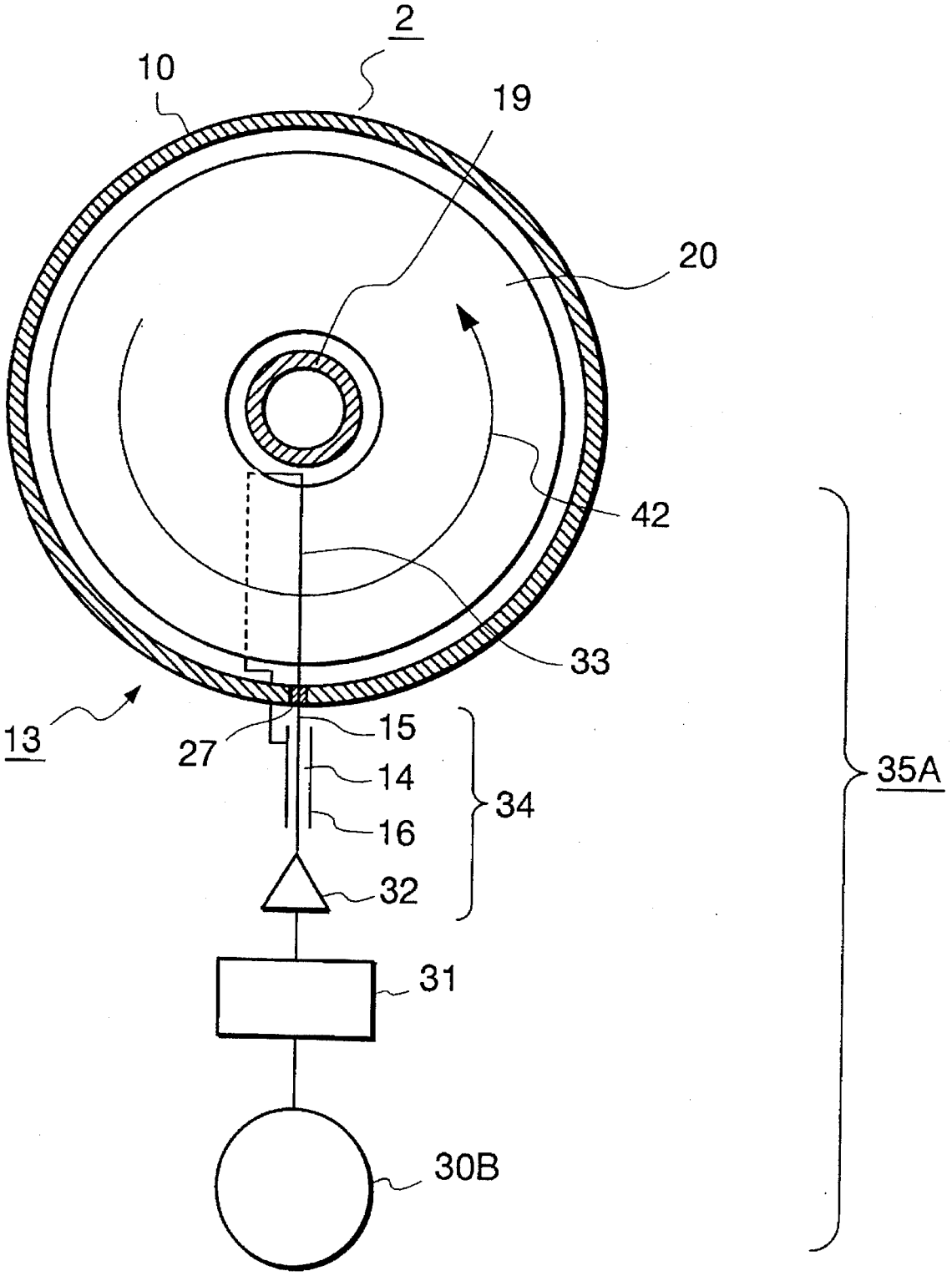
FIG. 6 is a cross-sectional view of the ion beam accelerating device of FIG. 4 taken along the line VI—VI in FIG. 5.

Accelerating cavity 2 according to this example of the invention is of an untuned type having the same configuration as that shown in FIG. 5, except for the core winding portions.

In this example of the invention, eight toroidal magnetic cores 20 are grouped into four groups each having two toroidal magnetic cores 20, and respective power supply lines 34 are provided for respective groups of toroidal magnetic cores 20.

High frequency magnetic field generating units 35B include high frequency power source 30B, which outputs high frequency power, a power splitter 31B having one input pin and four output pins, the input pin thereof being connected to the high frequency power source 30B, respective power supply lines 34 connected to respective output pins of the power splitter 31B, and respective winding portions 33 connected to the other ends of the respective power supply lines 34.

Coaxial cable 14 is electrically connected in the same way as in the example of FIG. 5, but in this example, an inner conductor 15 of each coaxial cable 14 is wound around two adjacent toroidal magnetic cores 20 constituting one group of toroidal magnetic cores 20.

An equivalent circuit of this example is obtained from the equivalent circuit shown in FIG. 3(*b*) by setting n=4. Therefore, a resultant accelerating voltage $V_4$ generated in gap 12 will be given by substituting 4 for n in equation 4, so that n=4, resulting in the following equation 6:

$$V_4 = \sqrt{2PZ_4} = \sqrt{4\left(2\frac{4\frac{Z_d}{4}Z_0}{\left(\frac{Z_d}{4}+Z_0\right)^2}\frac{Z_d}{4}\frac{P_g}{4}\right)} \simeq 2V_d\,(Z_d >> Z_0) \quad \text{(eq. 6)}$$

where $V_d$ is the accelerating voltage that the direct coupling accelerating cavity of the prior art generates. As is obvious from equation 6, the accelerating cavity 2 of this example can produce an accelerating voltage about twice as great as $V_d$.

Now, regarding the impedance of this example of the invention, in terms of a single power supply line 34, the impedance $Z_4$ of the accelerating cavity 2 becomes $Z_4/4$ which is an impedance of two magnetic cores 20 constituting one group.

Namely, according to this example of the invention, the load impedance $Z_4$ in each power supply line 34 decreases so as to approach the characteristic impedance $Z_0$ of the power supply line.

Thereby, like in the previous examples, the utilization efficiency of the high frequency power is substantially improved.

As noted in the example of FIG. 8 in which the plurality of magnetic cores are divided into groups, each having the same number of magnetic cores, and in which respective power supply lines 34 are provided for respective groups of magnetic cores, the same advantage and result of the invention can be attained through the same action due to inductive coupling, thereby ensuring an improved utilization efficiency of the high frequency power and a greater accelerating voltage.

Further, the number of groups into which the magnetic cores are to be divided is not limited to four, and any number of groups may be adopted within the scope of the invention. By way of example, when the plurality of magnetic cores are assumed to be within one group having a single power supply line 34 and a single high frequency power source 30B, then such an arrangement will exhibit the same characteristic and performance as the direct coupling arrangement.

What is claimed is:

1. An ion beam accelerating device comprising:

an accelerating cavity outer conductor having a space inside and having a wall;

an accelerating cavity inner conductor extending through the wall of the accelerating cavity outer conductor into the space inside the accelerating cavity outer conductor, the accelerating cavity inner conductor having a passage through which an ion beam passes during operation of the ion beam accelerating device;

a plurality of magnetic cores disposed in the space inside the accelerating cavity outer conductor, each of the cores surrounding the accelerating cavity inner conductor;

a plurality of high frequency power transmission units, each of the high frequency power transmission units being connected to a respective one of the magnetic cores;

a plurality of amplifiers, each of the amplifiers being connected to a respective one of the high frequency power transmission units; and a plurality of high frequency power generators, each of the high frequency power generators being connected to a respective one of the amplifiers;

wherein each of the high frequency power generators generates high frequency power which is amplified by a respective one of the amplifiers and is then transmitted to a respective one of the magnetic cores by a respective one of the high frequency power transmission units, thereby causing the respective magnetic core to generate a respective magnetic field.

2. An ion beam accelerating device according to claim 1, wherein each of the magnetic cores has a toroidal shape.

3. An ion beam accelerating device according to claim 1, wherein each of the high frequency power transmission units includes a respective coaxial cable, the coaxial cable having an internal conductor which is wound around a respective one of the magnetic cores, and an outer conductor which is electrically connected to the accelerating cavity outer conductor.

4. A circular accelerator comprising:

a vacuum duct having a passage through which an ion beam passes during operation of the circular accelerator;

an injector accelerating device for accelerating an ion beam;

an injector for injecting the ion beam which has been accelerated by the injector accelerating device into the vacuum duct;

at least one bending magnet disposed along the vacuum duct;

at least one quadrupole magnet disposed along the vacuum duct;

an ion beam accelerating device according to claim 1 disposed along the vacuum duct such that the ion beam which passes through the passage of the vacuum duct during operation of the circular accelerator also passes through the passage of the accelerating cavity inner conductor of the ion beam accelerating device; and an extractor for extracting the ion beam from the ion duct to an experimental laboratory or medical treatment room.

5. An ion beam accelerating device comprising:

an accelerating cavity outer conductor having a space inside and having a first wall and a second wall, the second wall being opposite the first wall;

a first accelerating cavity inner conductor extending through the first wall of the accelerating cavity outer conductor into the space inside the accelerating cavity outer conductor, the first accelerating cavity inner conductor having a passage through which an ion beam passes during operation of the ion beam accelerating device;

a second accelerating cavity inner conductor extending through the second wall of the accelerating cavity outer conductor into the space inside the accelerating cavity outer conductor, the second accelerating cavity inner conductor having a passage through which the ion beam passes during operation of the ion beam accelerating device, the second accelerating cavity inner conductor being spaced apart from the first accelerating cavity inner conductor in the space inside the accelerating cavity outer conductor, the passage of the second accelerating cavity inner conductor being axially aligned with the passage of the first accelerating cavity inner conductor;

a plurality of magnetic cores disposed in the space inside the accelerating cavity outer conductor, the magnetic cores being divided into a first group of magnetic cores surrounding the first accelerating cavity inner conductor and a second group of magnetic cores surrounding the second accelerating cavity inner conductor;

a plurality of high frequency power transmission units, each of the high frequency power transmission units being connected to a respective one of the magnetic cores;

a plurality of amplifiers, each of the amplifiers being connected to a respective one of the high frequency power transmission units;

a power splitter having an input and a plurality of outputs, each of the outputs of the power splitter being connected to a respective one of the amplifiers; and a high frequency power generator connected to the input of the power splitter;

wherein the high frequency power generator generates high frequency power which is split by the power splitter and supplied to each of the amplifiers where it is amplified and is then transmitted to a respective one of the magnetic cores by a respective one of the high frequency power transmission units, thereby causing the respective magnetic core to generate a respective magnetic field.

6. An ion beam accelerating device according to claim 5, wherein each of the magnetic cores has a toroidal shape.

7. An ion beam accelerating device according to claim 5, wherein each of the high frequency power transmission units includes a respective coaxial cable, the coaxial cable having an internal conductor which is wound around a respective one of the magnetic cores, and an outer conductor which is electrically connected to the accelerating cavity outer conductor.

8. An ion beam accelerating device comprising:

an accelerating cavity outer conductor having a space inside and having a wall;

an accelerating cavity inner conductor extending through the wall of the accelerating cavity outer conductor into the space inside the accelerating cavity outer conductor, the accelerating cavity inner conductor having a passage through which an ion beam passes during operation of the ion beam accelerating device;

a plurality of magnetic cores disposed in the space inside the accelerating cavity outer conductor, each of the cores surrounding the accelerating cavity inner conductor, the magnetic cores being divided into a plurality of groups of magnetic cores;

a plurality of high frequency power transmission units, each of the high frequency power transmission units being connected to a respective one of the groups of magnetic cores;

a plurality of amplifiers, each of the amplifiers being connected to a respective one of the high frequency power transmission units;

a power splitter having an input and a plurality of outputs, each of the outputs of the power splitter being connected to a respective one of the amplifiers; and a high frequency power generator connected to the input of the power splitter;

wherein the high frequency power generator generates high frequency power which is split by the power splitter and supplied to each of the amplifiers where it is amplified and is then transmitted to a respective one of the groups of magnetic cores by a respective one of the high frequency power transmission units, thereby causing the magnetic cores of the respective group of magnetic cores to generate respective magnetic fields.

9. An ion beam accelerating device according to claim 8, wherein each of the magnetic cores has a toroidal shape.

10. An ion beam accelerating device according to claim 8, wherein each of the high frequency power transmission units includes a respective coaxial cable, the coaxial cable having an internal conductor which is wound around a respective one of the groups of magnetic cores, and an outer conductor which is electrically connected to the accelerating cavity outer conductor.

11. An ion beam accelerating device comprising:

an accelerating cavity outer conductor having a space inside and having a first wall and a second wall, the second wall being opposite the first wall;

a first accelerating cavity inner conductor extending through the first wall of the accelerating cavity outer conductor into the space inside the accelerating cavity outer conductor, the first accelerating cavity inner conductor having a passage through which an ion beam passes during operation of the ion beam accelerating device;

a second accelerating cavity inner conductor extending through the second wall of the accelerating cavity outer conductor into the space inside the accelerating cavity outer conductor, the second accelerating cavity inner conductor having a passage through which the ion beam passes during operation of the ion beam accelerating device, the second accelerating cavity inner conductor being spaced apart from the first accelerating cavity inner conductor in the space inside the accelerating cavity outer conductor, the passage of the second accelerating cavity inner conductor being axially aligned with the passage of the first accelerating cavity inner conductor;

a plurality of magnetic cores disposed in the space inside the accelerating cavity outer conductor, the magnetic cores being divided into a first group of magnetic cores surrounding the first accelerating cavity inner conductor and a second group of magnetic cores surrounding the second accelerating cavity inner conductor, the first group of magnetic cores and the second group of magnetic cores each being divided into a plurality of subgroups of magnetic cores;

a plurality of high frequency power transmission units, each of the high frequency power transmission units being connected to a respective one of the subgroups of magnetic cores;

a plurality of amplifiers, each of the amplifiers being connected to a respective one of the high frequency power transmission units;

a power splitter having an input and a plurality of outputs, each of the outputs of the power splitter being connected to a respective one of the amplifiers; and a high frequency power generator connected to the input of the power splitter;

wherein the high frequency power generator generates high frequency power which is split by the power splitter and supplied to each of the amplifiers where it is amplified and is then transmitted to a respective one of the subgroups of magnetic cores by a respective one of the high frequency power transmission units, thereby causing the magnetic cores of the respective subgroup of magnetic cores to generate respective magnetic fields.

12. An ion beam accelerating device according to claim 11, wherein each of the magnetic cores has a toroidal shape.

13. An ion beam accelerating device according to claim 11, wherein each of the high frequency power transmission units includes a respective coaxial cable, the coaxial cable having an internal conductor which is wound around a respective one of the subgroups of magnetic cores, and an outer conductor which is electrically connected to the accelerating cavity outer conductor.

* * * * *